United States Patent [19]

Grosch

[11] 3,957,409

[45] May 18, 1976

[54] MEANS FOR CREATING PERFORATED CONCRETE CASING

[76] Inventor: Gottlieb W. Grosch, Silver Creek, Nebr. 68663

[22] Filed: Dec. 24, 1974

[21] Appl. No.: 532,763

[52] U.S. Cl. ..... 425/171; 249/53 R; 249/64; 249/137; 249/151; 425/290; 425/392; 425/453

[51] Int. Cl.[2] ..... B28B 7/18

[58] Field of Search ..... 425/392, 402, 468, 290, 425/294, 171, 453; 249/63–64, 151, 176–177, 137, 53

[56] References Cited

UNITED STATES PATENTS

| | | | |
|---|---|---|---|
| 2,181,958 | 12/1939 | Arborio | 249/176 |
| 2,275,080 | 3/1942 | Kelly | 249/176 |
| 2,287,858 | 6/1942 | Bespalow | 249/64 |
| 2,611,434 | 9/1952 | Mugler | 425/290 |
| 2,680,276 | 6/1954 | Filangeri | 249/64 |
| 3,345,716 | 10/1967 | Uden | 249/151 |
| 3,411,461 | 11/1968 | Groth | 425/290 |
| 3,876,354 | 4/1975 | Kuita et al. | 425/262 |

*Primary Examiner*—Francis S. Husar
*Assistant Examiner*—John McQuade
*Attorney, Agent, or Firm*—Zarley, McKee, Thomte, Voorhees & Sease

[57] ABSTRACT

The means for creating perforated concrete casing comprises a hollow cylindrical canister having a plurality of spaced apart rows of elongated openings formed therein. The elongated openings in each row are horizontally disposed and are vertically spaced. A first support means is secured to the outside surface of the canister adjacent each row of openings. A plurality of vertically spaced plates are mounted on each of the first support means and are selectively movable into and out of the openings of the associated row. A second support means extends upwardly through the canister and has a plurality of vertically spaced wedges mounted thereon. The second support means is movable towards the canister so that the wedges will penetrate the stiff concrete positioned adjacent the inside surface of the canister so as to create tapered perforations therein. Means is provided for rotating the canister so that the wedges may successively communicate with the row of perforations created by the plates on the first support means. The method comprises the steps of: (1) extending the plates on all of the first support means into the elongated openings formed in the canister; (2) depositing a layer of stiff concrete adjacent the inside surface of the canister so that the plates are imbedded therein; (3) removing the plates from the stiff concrete thereby creating rows of perforations in the concrete; (4) extending a row of vertically spaced apart wedges through the stiff concrete from the inside surface thereof so that the wedges communicate with the perforations so as to enlarge the same and to alter the shape thereof; (5) removing the wedges from the perforations; (6) repeating the wedging process until all of the perforations have been enlarged and altered; and (7) removing the canister from the stiff concrete.

7 Claims, 8 Drawing Figures

MEANS FOR CREATING PERFORATED CONCRETE CASING

BACKGROUND OF THE INVENTION

This invention relates to a means for forming perforated concrete casing and more particularly to a means for forming perforated concrete casing which amounts in a substantial savings of time and money.

Perforated concrete casing is frequently used in water wells or the like. It is necessary to create perforations in the casing so that water may enter the interior of the casing for subsequent pumping to the surface. Heretofore, the method of creating the perforations was extremely time-consuming and costly due to the large number of individual steps wich were required. This is especially true where the perforations are tapered such as is common in a vast majority of the cases.

A further object of the invention is to provide an improved means for forming perforated concrete casing.

A still further object of the invention is to provide a device for forming perforated concrete casing wherein a plurality of plates are imbedded in the stiff concrete during the formation of the casing and wherein a plurality of wedges are subsequently forced through the stiff concrete so as to create the desired perforations.

A further object of the invention is to provide means for forming perforated concrete casing which substantially reduces the steps, time and expense normally associated therewith.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT AND METHOD

Figure 1:
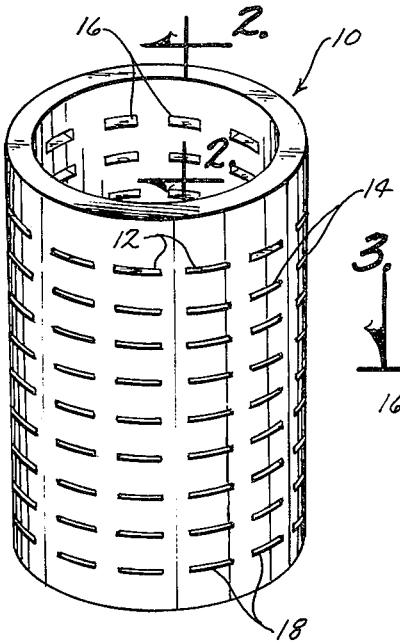
FIG. 1 is a perspective view of the perforated concrete casing formed through the means of this invention.
Figure 2:
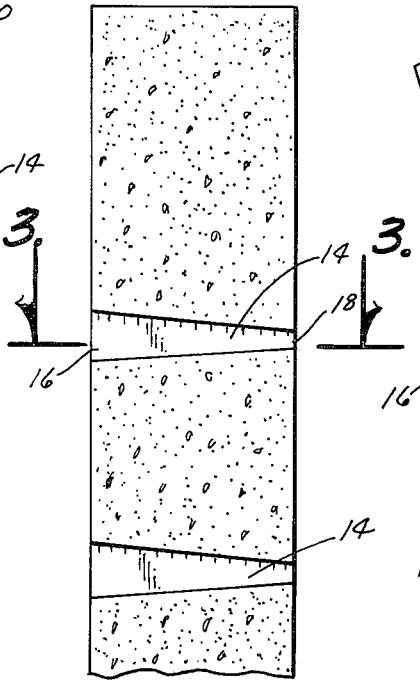
FIG. 2 is a sectional view of the casing seen on lines 2— 2 of FIG. 1.
Figure 3:
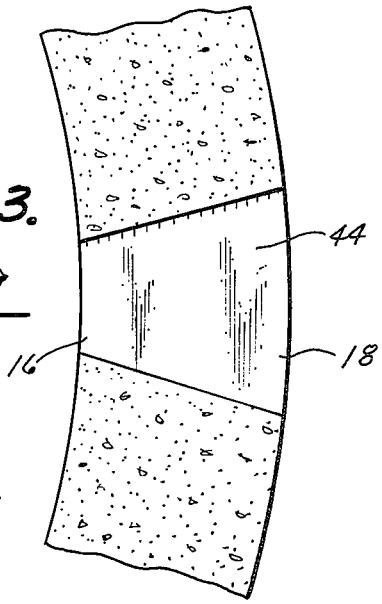
FIG. 3 is a sectional view as seen on lines 3 — 3 of FIG. 2.

In FIG. 1, the numeral 10 refers generally to the finished concrete casing which is produced through the means of this invention. Casing 10 includes a plurality of rows 12 of openings or perforations 14. As seen in FIG. 2, each of the openings 14 has an inner end 16 which has a vertical height greater than the outer end 18 thereof. As seen in FIG. 3, the outer end 18 of each of the openings 14 has a horizontal width greater than the horizontal width of the inner end 16 thereof.

Figure 4:
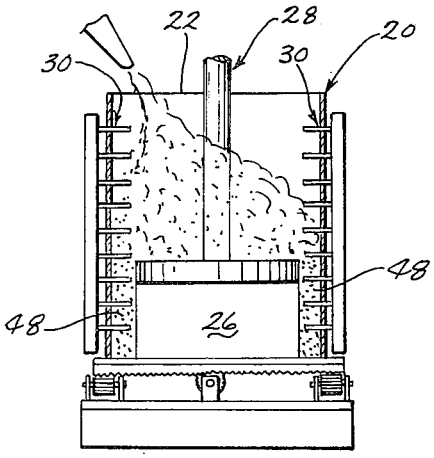
FIG. 4 is a vertical sectional view illustrating the manner in which a layer of concrete is applied to the inside surface of the canister.

In the drawings, the numeral 20 refers generally to a hollow cylindrical canister or container having an upper end 22, lower end 24 and a hollow interior 26. Preferably, the canister 20 is constructed of a metal material and includes means for "splitting" the same or means to open the same to facilitate the removal of the canister from the concrete as will be described in more detail hereinafter. In FIG. 4, the numeral 28 refers generally to a trowel member forming a part of a conventional casing casting apparatus. The canister 20 is provided with a plurality of rows 30 of openings 32. Each of the openings 32 is elongated so that its longitudinal axis is horizontally disposed. Each of the openings 32 in the rows 30 are vertically spaced. The rows 30 are radially spaced on the canister 20 at any desired distance depending upon the desired finished product. The space between the openings 32 is also dependent upon the desired finished product.

Figure 5:
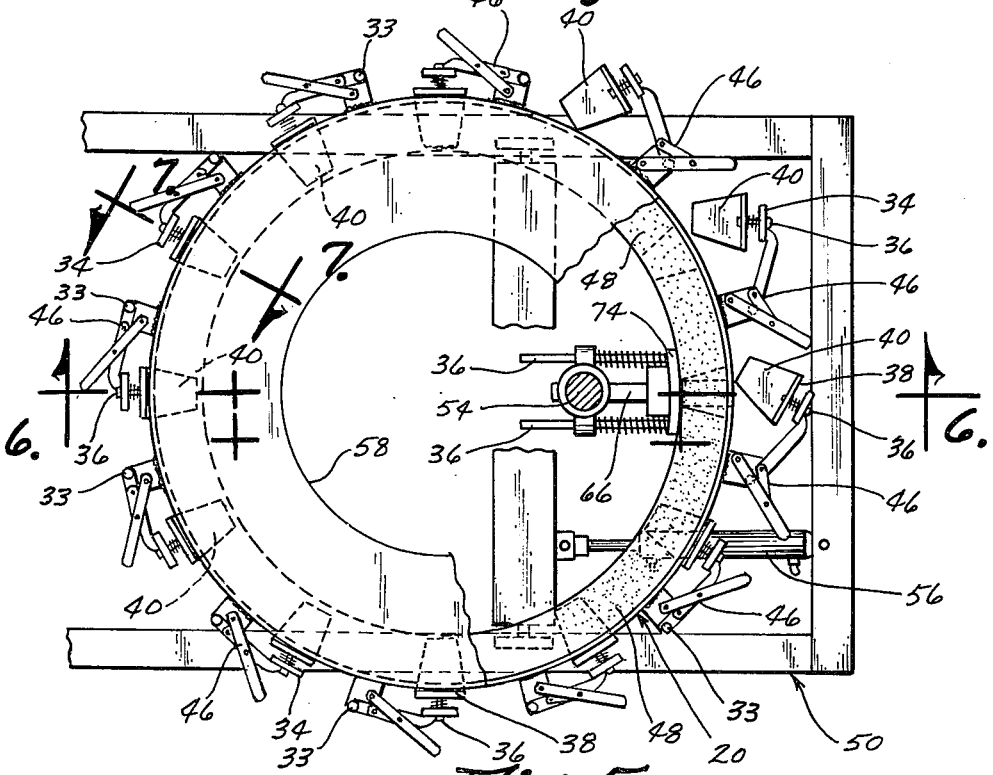
FIG. 5 is a top view of the apparatus.

A shaft 33 is suitably secured to the exterior surface of the canister adjacent each of the rows 30 and has a plurality of collars 35 rotatably mounted thereon. A plate 34 is secured to each of the collars 35 and extends horizontally therefrom. A bolt 36 extends through each of the plates 34 and has its other end received by plate 38. Plate members 40 and 42 are secured and extend inwardly from each of the plates 34 in a spaced apart relationship. Spring 44 embraces bolt 36 between the plates 34 and 38 so as to yieldably urge the plate 34 and the plate members 40 and 42 outwardly away from the plate 38. As seen in FIG. 5, each of the plate members 40 and 42 are tapered so that their ends have a have a horizontal width less than the outer ends thereof. A locking lever assembly 46 is operatively secured to the bar 38 so that all of the plates 40 and 42 operatively connected to the bar 38 can be selectively moved into and out of the openings 32 in each row 30.

Figure 6:
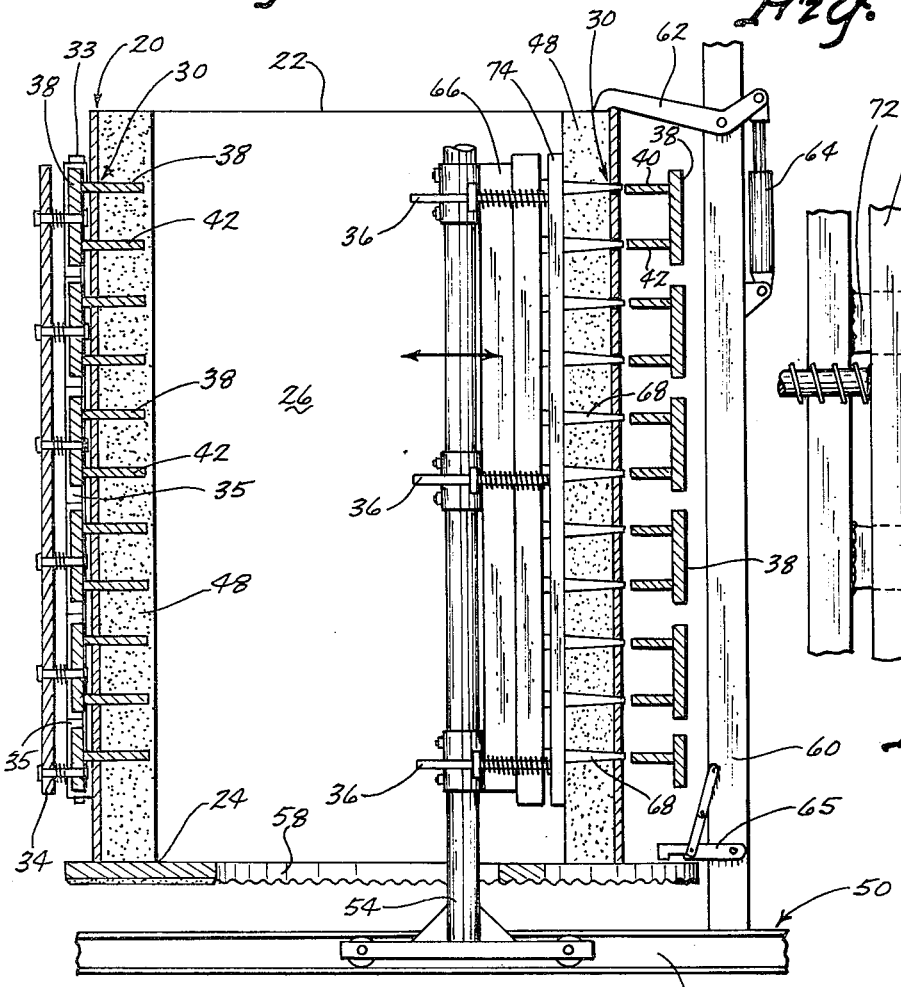
FIG. 6 is a sectional view seen on lines 6 — 6 of FIG. 5.

After all of the plates 40 and 42 have been moved into the openings 32 in each of the rows 30, the canister 20 is then placed in position on the casting mechanism 28 where a layer of stiff concrete, referred to generally by the reference numeral 48, is placed adjacent the inside surface of the canister so that the plates 40 and 42 are embedded therein. When the layer 48 has been applied to the inside surface of the canister, the canister and the layer of concrete adhering thereto is placed upon an apparatus referred to generally by the reference numeral 50. Apparatus 50 includes a frame means 52 having an upstanding post or support 54 horizontally movably mounted thereon by any conventional means such as by a hydraulic cylinder 56 operatively connected thereto. Apparatus 50 also includes a conventional turn table 58 which may be rotated by any conventional means relative to the post 54. As seen in FIG. 6, the lower end of the canister is adapted to be positioned on the turn table 58. The apparatus 50 would also include means for centering the canister 20 relative to the turn table. Apparatus 50 includes an upstanding post 60 having a lever or arm 62 pivotally mounted thereon which is operated by an air or hydraulic cylinder 64. As seen in FIG. 6, the lever 62 is adapted to engage the upper end of the canister 20 to positively maintain the canister in position during each of the wedging operations as will be described in more detail hereinafter. The numeral 65 refers to an indexing apparatus which is adapted to position the canister 20 in various of its rotational positions relative to the support 54.

A support 66 is rigidly secured to the post 54 and has a plurality of vertically spaced and horizontally disposed wedges 68 extending therefrom. The wedges 68 are tapered so that the outer ends 70 have a vertical thickness less than the inner ends 72 and so that the outer ends 70 have a horizontal width less than the horizontal width of the inner ends thereof. A stripper plate 74 is spring mounted on the post 54 and has a plurality of openings formed therein through which the wedges 68 extend. The stripper plate 74 is arcuate and is adapted to engage the inside surface of the layer of concrete as also will be described in more detail hereinafter. The numeral 67 refers to the means for spring loading the plate 74.

Figure 7:
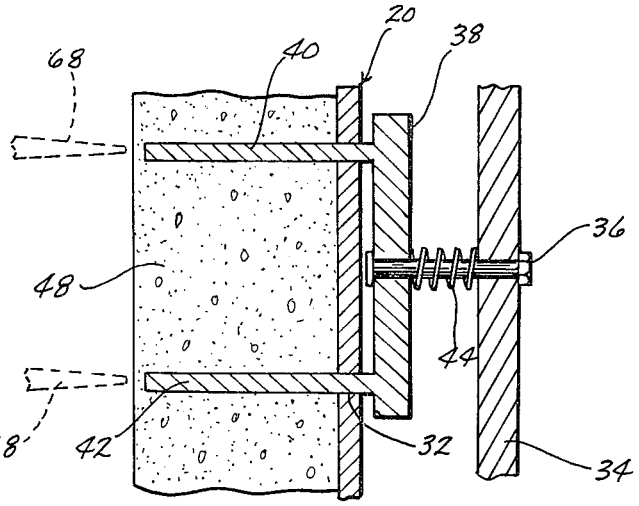
FIG. 7 is an enlarged sectional view seen on lines 7 — 7 of FIG. 5.

Assuming that the canister 20 and the layer of stiff concrete adhering thereto has been placed on the turn table 58, the turn table 58 is rotated so that a row of the openings 30 are aligned with the wedges 68. The alignment of the row 30 with the wedges 68 is enhanced by the indexing apparatus 65. The hydraulic cylinder 64 is then actuated so that lever 62 moves downwardly into engagement with the upper end of the canister 20 to positively maintain the canister in its proper position. The plates 40 and 42 are then removed from the stiff concrete. As seen in FIG. 7, the inner ends of the plates 40 and 42 do not quite completely penetrate the layer of stiff concrete.

Figure 8:
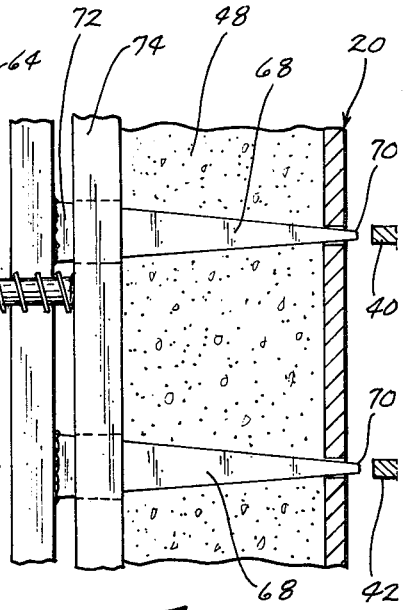
FIG. 8 is a partial sectional view seen on lines 6 — 6 of FIG. 5.

Post 54 is then actuated so that it is moved towards the canister which causes the stripper plate 74 to engage the inside surface of the concrete and which causes the wedges 68 to penetrate or to register with the perforations previously created by the plates 40 and 42. The shape of the wedges 68 has been designed so that the wedges 68 enlarge and alter the previously formed perforations so that the perforations 14 having the configuration previously described are created. The outer ends of the wedges 68 actually move slightly into the openings 32 in the canister as illustrated in FIG. 8 during the wedging process. When wedges 68 have penetrated the layer of concrete, post 54 is moved away from the canister with the stripping plate 74 assisting in preventing damage to the concrete as the wedges 68 are removed therefrom. When the wedgs 68 have been completely removed from the concrete, cylinder 64 is actuated to move the lever 62 out of engagement with the upper end of the canister 20. Indexing apparatus 65 is then moved upwardly and the turn table 58 is rotated until the next row 30 is in the proper position relative to the wedges 68. The welding operation is then successively repeated until all of the perforations in the stiff concrete have been enlarged and altered. The canister 20 is then removed from the turn table 58 and is stripped from the concrete casing with the resulting product of FIG. 1 being produced. The casing 10 is then cured or allowed to harden in conventional fashion.

Thus it can be seen that a unique means has been provided for forming or creating perforated concrete casing which substantially reduces the time and expense ordinarily involved with such a manufacturing process. The means of this invention not only creates the desired perforations in a concrete casing but also does so in a manner which is much more efficient than heretofore possible. The means permits the perforations to be created with a minimum of material wastage and with a minimum of imperfect finished products resulting.

Thus it can be seen that the means accomplishes at least all of its stated objectives.

I claim:

1. A device for forming perforated concrete casings
a turntable means,
a cylindrical canister having upper and lower ends, inside and outside surfaces, said canister being removably mounted on said turntable means,
means for placing a layer of stiff concrete adjacent the inside surface of said canister,
said canister having a plurality of spaced-apart rows of elongated openings formed therein, the elongated openings in each row being horizontally disposed and vertically spaced, said rows extending completely around said canister,
a first support secured to the outside surface of said canister adjacent each row of openings,
a plurality of vertically spaced plates mounted on each of said first supports and being selectively movable into and out of the openings of the associated row of openings so that perforations may be created in the concrete to form a perforated concrete casing having perforations formed therein completely therearound, a movable second support extending into the center area of said canister, a plurality of vertically spaced apart wedge members mounted on said second support, and means for moving said second support towards said canister to cause said wedge members to penetrate the concrete to create perforations therein, said wedge members extending into the perforations created in the concrete by the plates on the said first supports.

2. The device of claim 1 wherein a stripping plate is mounted on said second support and has a plurality of vertically spaced openings formed therein for movably receiving said wedge members therein, said stripping plate being substantially vertically disposed and having an outer end portion adapted to yieldably engage the inside surface of concrete adjacent the inside surface of said canister.

3. The device of claim 1 wherein each of said wedge members have inner and outer ends and are horizontally disposed, the outer ends of said wedge members having a vertical thickness less than the vertical thickness of the inner ends thereof.

4. The device of claim 3 wherein the inner ends of said wedge members have horizontal widths greater than the horizontal width of the outer ends thereof.

5. A device for forming perforated concrete casings,
a turntable means,
a cylindrical canister having upper and lower ends, inside and outside surfaces, said canister being removably mounted on said turntable means,
means for placing a layer of stiff concrete adjacent the inside surface of said canister,
said canister having a plurality of spaced-apart rows of elongated openings formed therein, the elongated openings in each row being horizontally disposed and vertically spaced, said rows extending completely around said canister,
a first support secured to the outside surface of said canister adjacent each row of openings,
and a plurality of vertically spaced plates mounted on each of said first supports and being selectively movable into and out of the openings of the associated row of openings so that perforations may be created in the concrete to form a perforated concrete casing having perforations formed therein completely therearound.

a movable second support extending through the center area of said canister, a plurality of vertically spaced-apart wedge members mounted on said second support, and means for moving said second support towards said canister to cause said wedge members to penetrate the concrete to create perforations therein, said wedge members extending into the perforations created in the concrete by the plates on the said first supports, said second support extending upwardly through said turntable means.

6. The device of claim 5 wherein an indexing means is mounted on said turntable means for positioning said turntable means relative to said canister so that said wedge members will be aligned with a row of elongated openings.

7. In combination, a rotatable turntable, means for rotating said turntable, a cylindrical canister having upper and lower ends and removably supported on said turntable, said canister adapted to have a layer of stiff concrete positioned adjacent the inner surface thereof, said canister having a plurality of spaced-apart rows of elongated openings formed therein, the elongated openings in each row being horizontally disposed and vertically spaced, a plurality of first supports (means) secured to the outside surface of said canister, one of said first supports being positioned adjacent each row of openings, a plurality of vertically spaced-apart plates mounted on each of said first supports and being selectively movable into and out of the openings of the associated row of openings, a movable second support extending upwardly through said turntable and said canister, said second support having a plurality of horizontally disposed and vertically spaced-apart wedge members thereon, means for moving said second support towards said canister to cause said wedge members to penetrate the layer of concrete adjacent the inner surface of said canister to create perforations therein, said wedge members extending into the perforations created in the casing by the plates on the first supports.

* * * * *